US011732485B2

(12) United States Patent
Livermore

(10) Patent No.: US 11,732,485 B2
(45) Date of Patent: Aug. 22, 2023

(54) ADJUSTABLE RAISED FLOOR SUPPORT SYSTEM AND METHODS

(71) Applicant: Jeremy Livermore, Orange, CA (US)

(72) Inventor: Jeremy Livermore, Orange, CA (US)

( * ) Notice: Subject to any disclaimer, the term of this patent is extended or adjusted under 35 U.S.C. 154(b) by 94 days.

(21) Appl. No.: 17/517,667

(22) Filed: Nov. 3, 2021

(65) Prior Publication Data

US 2023/0134333 A1 May 4, 2023

(51) Int. Cl.
*E04F 15/02* (2006.01)
*E04F 15/024* (2006.01)

(52) U.S. Cl.
CPC ..... *E04F 15/0247* (2013.01)

(58) Field of Classification Search
CPC ..... E04F 15/0247; E04F 15/02464; E04F 15/02476; E04F 15/02482
See application file for complete search history.

(56) References Cited

U.S. PATENT DOCUMENTS 6,484,450 B1 * 11/2002 Suprina ..... E04H 3/126 52/9

FOREIGN PATENT DOCUMENTS

FR 3054577 A1 * 2/2018 ..... E04F 15/02044
WO WO-2018121892 A1 * 7/2018 ..... E04F 15/02447

* cited by examiner

*Primary Examiner* — Patrick J Maestri
(74) *Attorney, Agent, or Firm* — Aaron P. McGushion

(57) ABSTRACT

An adjustable support for supporting a raised floor above a ground surface through a post is described herein. The adjustable support generally includes a base threadably engaged to a post engagement structure, where rotation of the post engagement structure relative to the base brings the post engagement structure into supportive contact with the bottom end of the post. The base includes a large diameter bottom plate that is able to distribute the load of the raised floor over a large ground area to prevent unacceptable compaction of the soil that would cause sinking. Buttress threads are configured to bear the load of the raised floor and enable the adjustable supports to be permanently installed. Because the adjustable support is made of a polymer material, it resists rotting and deterioration.

20 Claims, 4 Drawing Sheets

ADJUSTABLE RAISED FLOOR SUPPORT SYSTEM AND METHODS

BACKGROUND

The subject of this patent application relates generally to foundation repair, and more particularly, to devices for supporting raised floor structure on a support surface, such as soil.

By way of background, numerous houses and other structures have post and pier foundations supporting a raised floor. Generally, in post and pier foundation applications, a floor is supported by a series of joints, which, in turn, are supported by girders or beams. Vertical wood posts are attached to the girders or other portion of the floor structure by a top end and extend downwards to a concrete pier. Commonly, the concrete pier has a 10.75"×10.75" square base and a top surface covered by a wood cap for nailing thereto the bottom end of the wood post. The concrete pier is generally set directly on the soil. Over time, the concrete piers often compress the soil there beneath, causing settlement or sinking of the pier such that the floor thereabove sags. Furthermore, concrete piers in crawl spaces that are exposed to corrosive elements, tend to deteriorate and require replacement.

Repair of this failure often requires workers to operate within the small confines of the crawl space beneath the house, where the worker excavates an 18"×18"×12" excavation pit and pours a concrete footing to properly support yet another concrete pier. This work is all done by hand, within a very limited space, for each of the failed piers. This is difficult and back-breaking work. Further, with existing systems, the post must be cut precisely and/or the level of the footing must be controlled to support the floor structure at the correct height to eliminate the sagging at each point, adding to the complexity of an already difficult job.

What is needed is a replacement for the concrete piers that is light-weight, easy to install, does not require the pouring of a footing, resistant to sinking on soil or other support surface, is resistant to corrosion, and that can be adjusted to support the raised floor structure at the correct height.

Aspects of the present invention fulfill these needs and provide further related advantages as described in the following summary.

SUMMARY

Aspects of the present invention teach certain benefits in construction and use which give rise to the exemplary advantages described below.

The present specification discloses an adjustable support for supporting a raised floor above a ground surface through a post, which includes a base threadably engaged to a post engagement structure, where rotation of the post engagement structure relative to the base brings the post engagement structure into supportive contact with the bottom end of the post. The base generally includes a bottom plate with a bottom surface and a first support structure extending upwardly from the bottom plate, where the first support structure is fixed to the bottom plate at a proximal portion and has a first thread with a first thread axis arranged substantially perpendicular to the bottom surface of the bottom plate, where the bottom surface of the bottom plate is configured to rest upon the ground surface when installed. The post engagement structure generally includes a post support on a top portion and a second thread opposite the top portion of the post support, where the post support is configured to hold thereon a bottom end of the post, and where the second thread is configured to selectively engage the first thread of the base to adjust a height of the post support relative to the base. During an installation procedure, a top end of the post is coupled with the raised floor, the bottom surface of the base is configured to be set on the ground surface beneath the post with the first thread threadably engaged with the second thread to adjustably couple the post engagement structure to the base, the post engagement structure is configured to be rotated to raise the height of the post engagement structure so that the post support contacts the bottom end of the post such that a load of the raised floor is transferred through the post, to the post engagement structure, into the base, and being distributed on the ground surface through the bottom plate.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
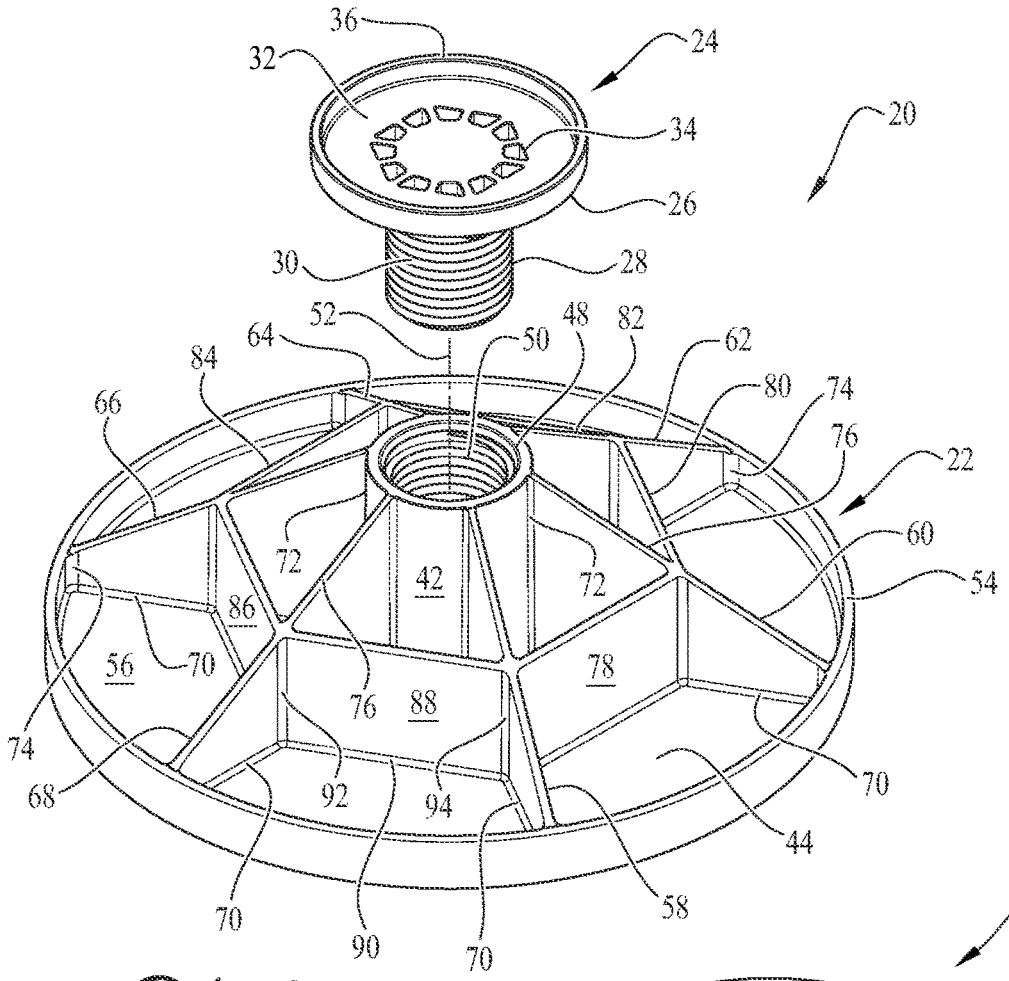
FIG. 1 is an exploded top perspective view of an exemplary embodiment of the present adjustable support.
Figure 2:
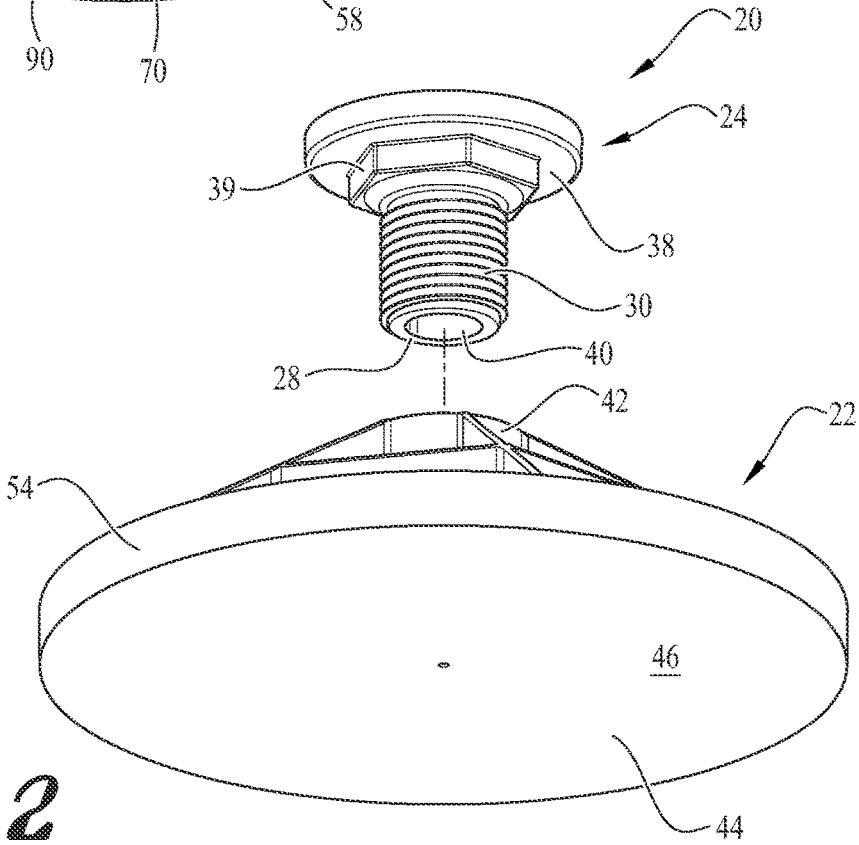
FIG. 2 is an exploded bottom perspective view of the adjustable support of FIG. 1.
Figure 3:
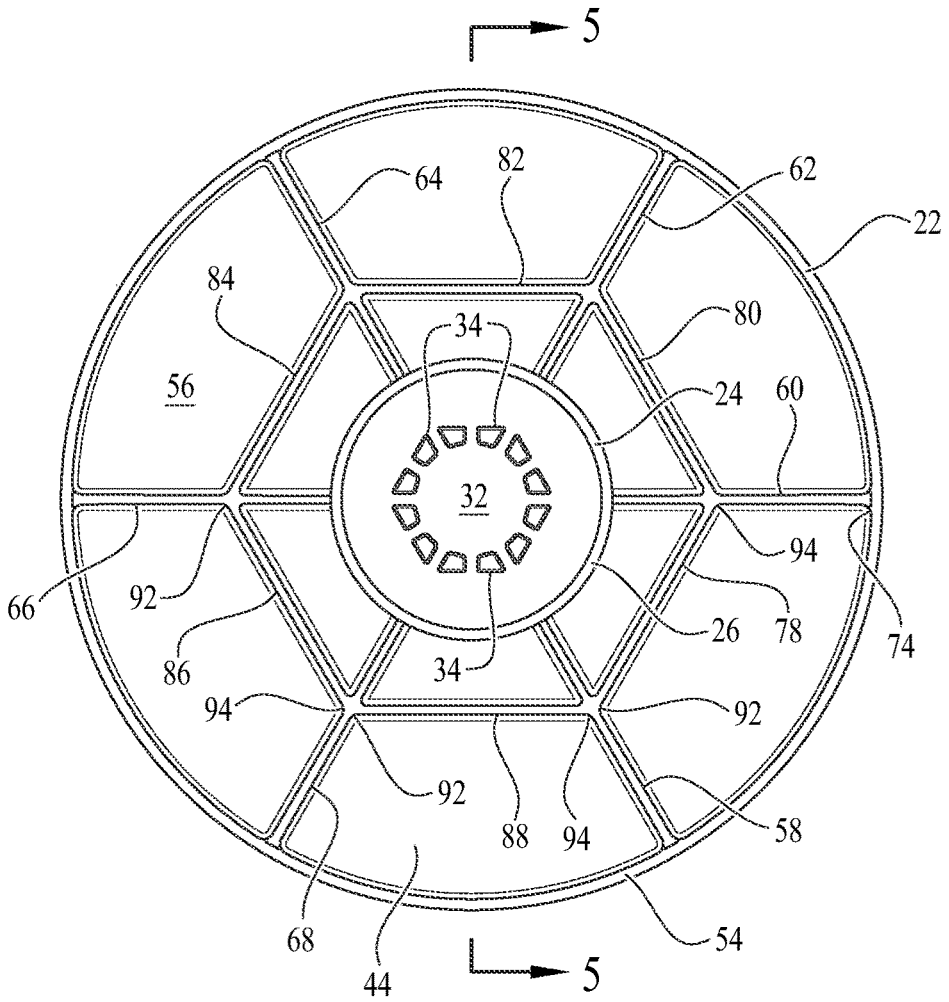
FIG. 3 is a top view of the adjustable support of FIG. 1.
Figure 4:
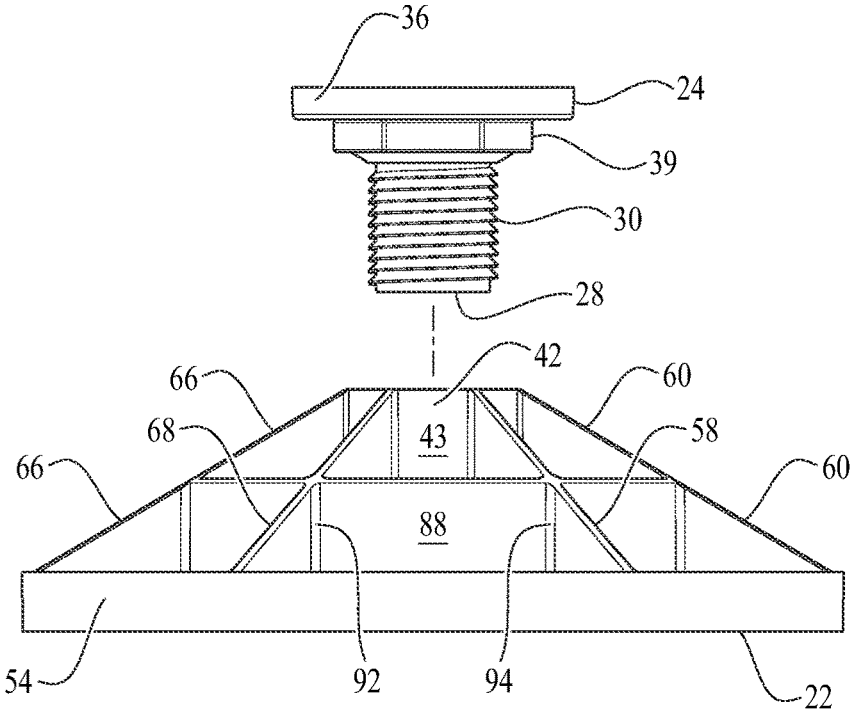
FIG. 4 is a side view of the adjustable support of FIG. 1.

The above-described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

The present devices and methods provide an adjustable support for supporting a raised floor above a ground surface through a post. The adjustable support generally includes a base threadably engaged to a post engagement structure, where rotation of the post engagement structure relative to the base brings the post engagement structure into supportive contact with the bottom end of the post. The base includes a large diameter bottom plate that is able to distribute the load of the raised floor over a large ground area to prevent unacceptable compaction of the soil that would cause sinking. Buttress threads are configured to bear the load of the raised floor and enable the adjustable supports to be permanently installed. Because the adjustable support is made of a polymer material, it resists rotting and deterioration.

Looking first at FIGS. 1-4, an example embodiment of the present adjustable support 20 is illustrated with the base 22 separated from the post engagement structure 24 and in alignment for assembly. The post engagement structure 24 generally includes a post support 26 with top portion 32 (which may also be referred herein as a top face) facing upwards and a bottom portion 38 (which may also be referred herein as a bottom face, opposite the top face) facing downwards, a top stiffening wall 36 extends upwards about the perimeter of the top portion 32, a hollow boss 28 (i.e., a tube-like structure) extends downwardly from the bottom portion 38 with a second thread 30 formed about the outer surface. The base 22 generally includes a bottom plate 44 with a bottom surface 46 opposite a top surface 56, a columnar structure 42 with an internal or first thread 50 extends perpendicularly upward from the top surface 56, a perimeter stiffening wall 54 extends upwardly from the top surface 56, a series of radial stiffening walls 58, 60, 62, 64, 66, 68 also extend upwardly from the top surface 56 connecting between the columnar structure 42 and the perimeter stiffening wall 54, and a series of transverse stiffening walls 78, 80, 82, 84, 86, 88 extend upwardly from the top surface 56 each connecting between neighboring radial stiffening walls 58, 60, 62, 64, 66, 68.

Looking first at the base 22, it is configured with a large bottom plate 44 having a bottom surface 46 that, in one or more embodiments, is configured to provide a sufficiently large surface area through which the load of the raised floor structure can be distributed on the ground surface without unacceptable subsidence during its useful life. In one or more embodiments, the surface area of the bottom surface 46 is at least 100 inches square, or is at least 150 inches square, or is at least 200 inches square, or is at least 250 inches square, or is at least 300 inches square, or is at least 350 inches square, or is at least 400 inches square, or is at least 450 inches square, or is at least 500 inches square. In one or more embodiments, the bottom plate 44 is round, but may be other shapes, such as rectangular or other polygonal shape, as well as oval or other curvilinear outline that defines the shape of the bottom plate 44.

In one or more embodiments, the perimeter stiffening wall 54 generally extends from the outer perimeter of the bottom plate 44 and follows the outline shape of the bottom plate 44 (e.g., the perimeter stiffening wall 54 is annular when the bottom plate 44 is round, as illustrated). The height of the perimeter stiffening wall 54 can be varied according to design requirements. In one or more embodiments, the height of the perimeter stiffening wall 54 above the top surface 56 of the bottom plate 44 is at least 0.25 inches, or is at least 0.5 inches, or is at least 0.75 inches, or is at least 1 inch, or is at least 1.25 inches, or is at least 1.5 inches, or is at least 1.75 inches, or is at least 2 inches. The purposes of the perimeter stiffening wall 54 include, but are not limited to, preventing warping and other deformations of the bottom plate 44 when under load conditions and providing a termination surface for the radial stiffening walls 58, 60, 62, 64, 66, 68. For example, without the perimeter stiffening wall 54, the bottom plate 44 would arch upwards between each neighboring radial stiffening walls 58, 60, 62, 64, 66, 68 due to the upward push of the soil between the radial stiffening walls 58, 60, 62, 64, 66, 68 with the localized compacting of the soil directly beneath each radial stiffening walls 58, 60, 62, 64, 66, 68. Localized compaction of the soil would tend to undesirably concentrate the load on the soil rather than evenly distributing the load. Although the perimeter stiffening wall 54 is illustrated in the example embodiment as delineating the outer annular perimeter of the bottom plate 44, the perimeter stiffening wall 54 can be positioned inward of (e.g., offset from) the perimeter of the bottom plate 44, such that the diameter of the perimeter stiffening wall 54 can be smaller than the maximum diameter of the bottom plate 44. Further, the outline shape of the perimeter stiffening wall 54 can differ from the outline shape of the bottom plate 44. For example, the bottom plate 44 can have a circular outline shape, while the perimeter stiffening wall 54 can have a polygonal outline shape.

To prevent warping or curving about one or more axes, a plurality of radial stiffening walls 58, 60, 62, 64, 66, 68 are provided. In the example embodiment illustrated, there are six radial stiffening walls 58, 60, 62, 64, 66, 68 radiating outwardly from the outer wall 43 of the columnar structure 42 and evenly spaced about 360 degrees. Since the base 22 is the example embodiment is molded as a single unit from a polymer material, it can be seen that the radial stiffening walls 58, 60, 62, 64, 66, 68, the bottom plate 44, the columnar structure 42, the transverse stiffening walls 78, 80, 82, 84, 86, 88, and the perimeter stiffening wall 54 are all molded together and attached at one or more surface and/or edges. The radial stiffening walls 58, 60, 62, 64, 66, 68 are each molded or otherwise connected at the centermost edge 72 to the outer wall 43 of the columnar structure 42. Further, the radial stiffening walls 58, 60, 62, 64, 66, 68 are each molded or otherwise connected at a bottom edge 70 to the top surface 56 of the bottom plate 44. Additionally, the radial stiffening walls 58, 60, 62, 64, 66, 68 are each molded or otherwise connected to the inner wall of the perimeter stiffening wall 54 at an outermost edge 74. Since the columnar structure 42 is taller than the height of the perimeter stiffening wall 54 (e.g., approximately 3 to 5 times taller, 1 inch versus approximately 5 inches in the present example), the radial stiffening walls 58, 60, 62, 64, 66, 68 each have a side face or profile that approximates a triangle truncated at the outermost edge 74 to match the height of the perimeter stiffening wall 54. The top edge 76 of each of the radial stiffening walls 58, 60, 62, 64, 66, 68 forms the hypotenuse of the truncated triangle and are angled approximately at 35 degrees (although the angle can change depending on the height of the columnar structure 42, the height of the perimeter stiffening wall 54, the diameter of the columnar structure 42, and the diameter of the bottom plate 44).

The present adjustable support 20 may be constructed of a variety of materials, including polymer materials, metal materials, composite materials, and so on. The base 22 and the post engagement structure 24 can be made of the same material or differing materials. Further, one or both of the base 22 and the post engagement structure 24 can be made of a single material or of multiple materials. For example, if certain portions of the base 22 or the post engagement structure 24 require the threads be made of a stronger material than the remaining portions, then an overmolding process can be used to utilize a stronger polymer for the threads, or a metal threaded insert may be used. In one or more example embodiments, the base 22 can be made of polypropylene PP and the post engagement structure 24 can be made of polycarbonate.

To prevent buckling of the radial stiffening walls 58, 60, 62, 64, 66, 68 under load, a plurality of transverse stiffening walls 78, 80, 82, 84, 86, 88 are provided, each spanning between two respective radial stiffening walls 58, 60, 62, 64, 66, 68. For example, transverse stiffening wall 88 spans between radial stiffening wall 58 and radial stiffening wall 68, connecting to each respectively by the second edge 94 and the first edge 92 of the transverse stiffening wall 88. The transverse stiffening walls 78, 80, 82, 84, 86, 88 extend upwardly from the top surface 56 of the bottom plate 44 in the region of the top surface 56 between the columnar structure 42 and the perimeter stiffening wall 54.

To ensure the bottom plate 44 remains substantially flat (e.g., planar) and to ensure the columnar structure 44 sufficiently buttressed and supported in a vertical orientation, the perimeter stiffening wall 54, the radial stiffening walls 58, 60, 62, 64, 66, 68, the transverse stiffening walls 78, 80, 82, 84, 86, 88 all work together with the bottom plate 44 and the columnar structure 42 to create a rigid, strong base 22 that transmits the load of the raised floor structure evenly to the large area of the bottom plate 44, such that soil beneath the bottom plate 44 is not substantially compacted to the point of causing failure of the floor structure thereabove. Furthermore, although the illustrated example embodiment discloses six radial stiffening walls 58, 60, 62, 64, 66, 68 evenly radiating about the columnar structure 42, fewer or more may be included, evenly or unevenly spaced.

The columnar structure 42 (which may also be referred to herein as a support structure or first support structure) extends upwardly from the bottom plate 44, and has the primary purposes of providing a connection means to the post engagement structure 24, such that the post engagement structure 24 height can be adjusted, and to transfer the load of the raised floor structure to the bottom plate 44. In the illustrated example embodiment, the columnar structure 42 illustrated as being cylindrical, but may come in a number of forms, such as conical or polygonal forms, and need not be strictly column-like in appearance (e.g., the columnar structure 42 can be shorter in height than the diameter. In the illustrated example embodiment, the columnar structure 42 includes a bore 48 with a first thread 50 internally formed (e.g., a female thread in this example), where the bore axis and the thread axis 52 are colinear and are substantially perpendicular (e.g., within 2, 4, 6, 8 or 10 degrees of perpendicular) to the bottom surface 46 of the bottom plate 44. During installation, the thread axis 52 should be arranged to be substantially vertical and parallel to gravity by preparation of the ground to provide a flat and level support surface. A small through hole is formed through the bottom plate 44 within the bore 48 to permit air enter and exit the bore 48 when threading the post engagement structure 24 into and out of the bore 48, respectively.

Looking more closely at the post engagement structure 24, in one or more embodiments, it includes a post support 26 with top portion 32 (which is plate-like or a flat disk in this example embodiment) facing upwards and a bottom portion 38 facing downwards, a top stiffening wall 36 extends upwards about the perimeter of the top portion 32, a hollow boss 28 extends downwardly from the bottom portion 38 with a second thread 30 formed about the outer surface. The hollow boss 28 further includes a hollow interior 40, which is a bore in this example that extends through the length of the hollow boss 28. Further, cooling holes 34 are provided through the top surface 32; and in one or more embodiments, the cooling holes 34 communicate with the hollow interior 40. Some of the purposes of the hollow boss 28 and the cooling holes 34 are for facilitating the injection mold process, where rapid cooling is beneficial and for saving raw material while not sacrificing strength. In the illustrated example, a plurality of cooling holes 34 are arranged in a circular or hexagonal array and are each configured as a blind hole extending into the hex nut portion 39 on the bottom portion 38. The hexagonal array pattern matches the general shape of the hex nut 39 flats. The hex nut portion 39 provides a tool purchase for rotating the post engagement structure 24 relative to the base 22. For example, a wrench can be applied to the hex nut portion 39 for applying a torque sufficient to turn the post engagement structure 24, even when under loading conditions, where hand turning is not practical. Yet another benefit of the hex nut portion 39 is to provide a corbel-like bracket for supporting the plate of the top portion 32. The top stiffening wall 36 serves to stiffen the top portion 32 as well. Further, the top portion 32 provides a lip to delineate a region that receive the bottom end of the post and prevents the post from sliding off the post engagement structure 24.

In the illustrated example embodiment, the post engagement structure 24 is disclosed as having a male thread (second thread 30) and the base 22 is disclosed as having a female thread (first thread 50). However, the male/female threads can be switched. For example, the columnar structure 42 can extend above the radial stiffening walls 58, 60, 62, 64, 66, 68 to provide a surface for a male thread. Furthermore, other mechanisms for adjusting and locking the height of the post engagement structure 24 relative to the base 22 are compatible with the present adjustable support 20. For example, a series of lateral through holes that are arranged in a vertical line can be provided through the columnar structure 42 and/or the hollow boss 28, and configured to receive therethrough a pin or bolt for holding the position of the post engagement structure 24.

Figure 5:
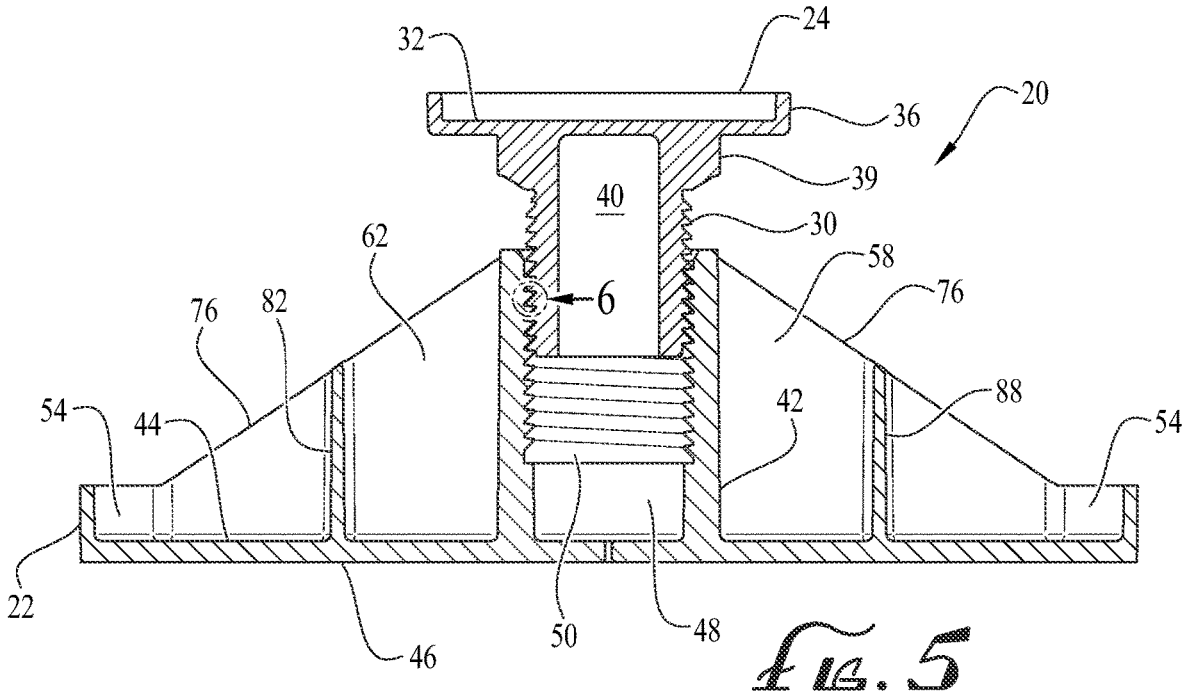
FIG. 5 is an assembled cross-sectional side view of the adjustable support of FIG. 1, taken at 5-5.
Figure 6:
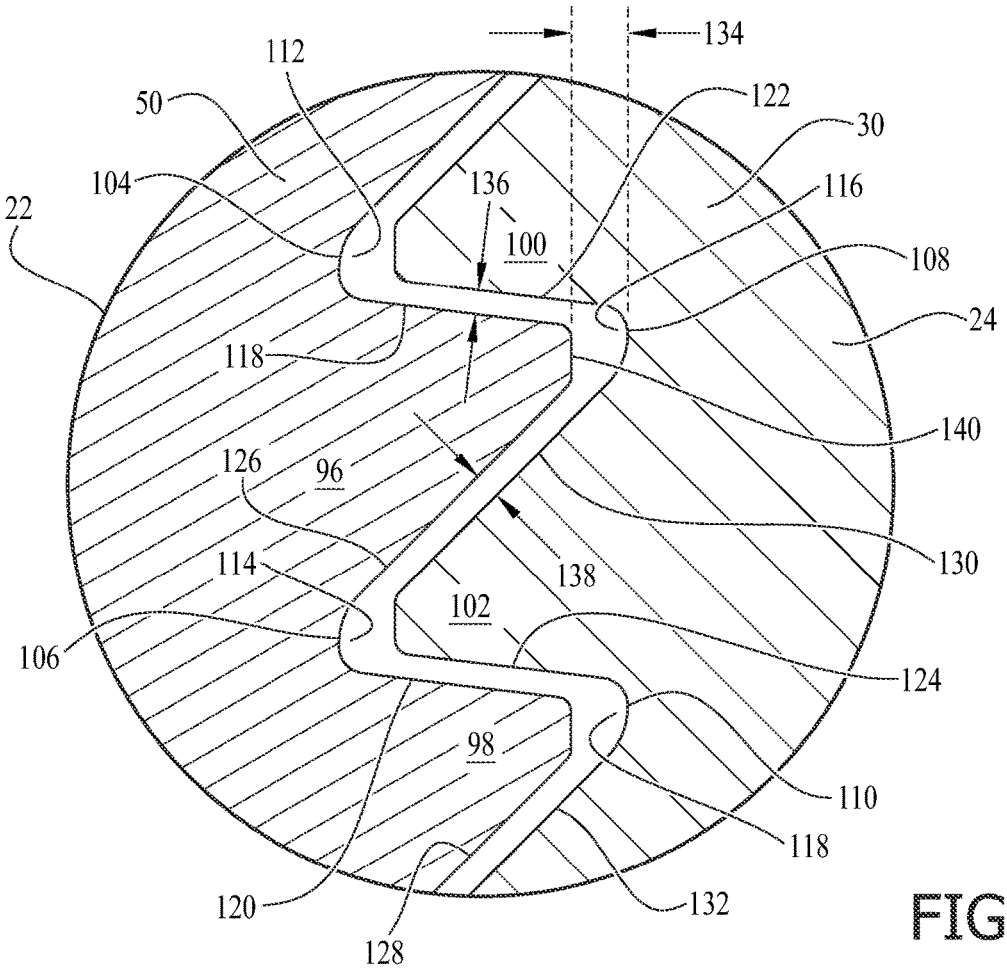
FIG. 6 is a magnified cross-sectional side view of the first thread and the second thread engaged.
Figure 7:
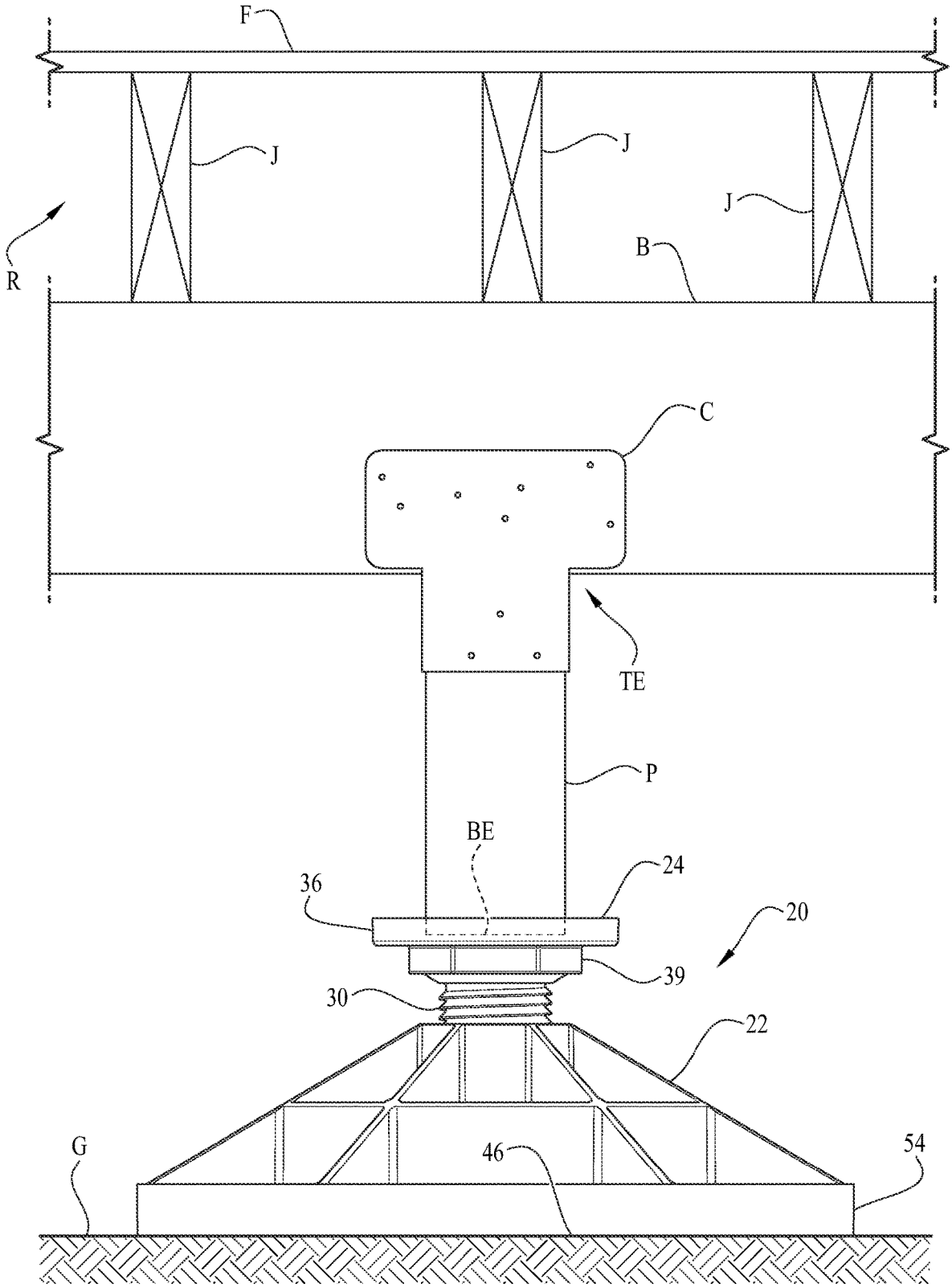
FIG. 7 is a side view of the adjustable support of FIG. 1, illustrating the final installation, where the post is fastened to the girder and is supported at a selected height by the present adjustable support.

Looking also at FIGS. 5-7, a typical raised wood floor structure R is illustrated, with a floor F supported from beneath by joists J, in-turn, supported by a beam B transversely arranged beneath the joists J. A wood post P (such as a 4×4 wood post) is positioned vertically beneath the beam B, with a top end TE of the post P positioned directly beneath and contacting the beam B and a bottom BE resting upon the top portion 32 of the post engagement structure 24. A post cap connector C fastens the top end TE of the post P to the underside of the beam B. Although the bottom end BE of the beam B rests upon the top portion 32 of the post engagement structure 24, they are not fastened together.

With the arrangement of FIG. 7, it can be understood that the load of the raised wood floor structure R (at least the portion of the load carried at that point) is fully supported by the first thread 50 and the second thread 30. Thus, the threads must be designed to withstand thousands of pounds without failure. For example, the design load in one example may be 3,000 pounds, and with a factor of safety of 3, the threads would need to support 9,000 pounds before failure of the threads or some other component of the adjustable support 20. Therefore, the first thread 50 and the second thread 30 are configured as buttress threads, which are generally characterized by a triangular-like (although often truncated or radiused at the roots and the crests) thread profiles with a horizontal load-bearing face (or near horizontal, such as within 10 or 15 degrees of horizontal) and an angled face that acts like a corbel or bracket for supporting and transferring the load into the structure. Further, the roots of each of the threads are radiused to eliminate stress risers.

FIG. 6 illustrates several portions of the second thread 30 threaded into and engaged with the first thread 50 shown in cross-section profile to view the interactions between the buttress of the first thread 50 and the buttress of second thread 30. Although just a small portion of the threads are shown and described in detail, they are illustrative of the remaining threads. It can be seen that gaps 134, 136, 138 are formed between the first thread 50 and the second thread 30 due to differences in the thread diameters. In the illustrated example embodiment, gaps 136, 138 are about 0.02 inched wide, while gap 134 is about 0.04 inches wide. The gaps provide clearance and permit the user to easily thread and unthread the post engagement structure 24 from the base 22.

The first thread 50 includes first buttress thread portions 96, 98, first thread root portions 104, 106 with a first root radius 112, 114, a first crest 140, and a first load bearing thread face 118, 120, and a first angled thread face 126, 128. The second thread 30 includes a second buttress thread 100, 102, a second thread root 108, 110, a second root radius 116, 118, a second load bearing thread face 122, 124, and a second angled thread face 130, 132. It is understood that the various portions of the threads, although described as separate parts, are continuous throughout the length of the screw.

Although gaps are illustrated in FIG. 6, this is only shown to illustrate the gaps or the offset between the two mating threads. Under a load condition, the second load bearing thread face 122, 124 will be pushed down into contact with the first load bearing thread face 118, 120 to transmit the load between the two threads. During stress analysis of the present example embodiment, it was found that the majority of the of the load was born by the distalmost thread pitches of the second thread 30 and the thread pitches of the first thread with which they are engaged. This, it is possible that just one or two mating thread pitches are required to bear the great majority of the load. The first root radius 112, 114 and the second root radius 116, 118 are compound curves with two radii of approximately 0.5 mm and 1.25 mm, but can be designed with different radii according to design requirements. Crest 140 is illustrative of all the crests, which are truncated (e.g., like a frustum) to provide clearance for the radiused roots.

During installation, the user may not be able to easily determine the number of thread pitches engaged, where too few engaged may result in failure. Thus, in one or more embodiments the second thread 30 can include a visual indicia of the number of threads engaged. For example, the distalmost thread pitches can be colored red, visually indicating to the user that insufficient threads are engaged and the post engagement structure 24 should be threaded further into the base 22. In one example, there are four threads per inch. If the minimum thread engagement is six thread pitches, then six of the distalmost thread pitches (or 1.5 inches) will be colored red. If the user can still see red, this indicate to the user that the threads must be further engaged. Adjacent to the red zone, there can be a yellow zone (one or more thread pitches colored yellow). This can indicate to the user that, ideally, more threads should be engaged, but the thread engagement may be acceptable when there is not other practical alternative. Finally, adjacent to the yellow zone and innermost, is the green zone (one or more thread pitches colored green), indicating to the user that sufficient thread pitches are engaged in any scenario. In yet another embodiment, there may only be a red zone or a red zone transitioning to a green zone.

During installation, the user can place the base 22 directly on the ground surface or within an excavated pit, with the post engagement structure 24 threaded deep into the base 22 so that there is clearance beneath the post P to easily emplace the adjustable support 20 beneath the post P. The user can then unthread the post engagement structure 24 until it contacts the bottom end BE of the post P. If the raised floor structure R is supported at the correct height by a jack or other temporary support, these can be removed to permit the full load to bear down upon the adjustable support 20. Furthermore, if after installation, perhaps years after, there is further settlement, the present adjustable support 20 can be again adjusted to compensate for the change in height to again level the floor.

Aspects of the present specification may also be described as follows:

1. An adjustable support for supporting a raised floor above a ground surface through a post, the adjustable support comprising a base having a bottom plate with a bottom surface and a columnar structure extending upwardly from the bottom plate, the columnar structure being fixed to the bottom plate at a proximal portion and having a bore formed into the columnar structure and having an internal buttress thread, an internal thread axis arranged substantially perpendicular to the bottom surface of the bottom plate, the bottom surface of the bottom plate configured to rest upon the ground surface when installed; and a post engagement structure having a post support on a top portion and a boss protruding from a bottom portion of the post support with an external buttress thread formed on the boss, the post support configured to hold thereon a bottom end of the post, the external buttress thread of the boss configured to threadably engage the internal buttress thread of the bore to adjust a height of the post support; wherein, during an installation procedure, a top end of the post is coupled with the raised floor, the bottom surface of the base is configured to be set on the ground surface beneath the post with the boss threadably inserted into the bore and the external buttress thread engaged with the internal buttress thread to adjustably secure the post engagement structure to the base, the post engagement structure is configured to be rotated to raise a height of the post engagement structure so that the post support contacts the bottom end of the post so that a load of the raised floor is transferred through the post, to the post engagement structure, into the base, to be distributed on the ground surface through the bottom plate.
2. The adjustable foundation support of embodiment 1 where the base further includes a perimeter stiffening wall coupled to and extending upwardly from the from a top surface of the bottom plate; a plurality of radial stiffening walls each radially extending upwardly from the top surface of the bottom plate and having a bottom edge coupled to the top surface, each of the plurality of radial stiffening walls having a centermost edge coupled to the columnar structure and an outermost edge coupled to the perimeter stiffening wall; and a transverse stiffening wall extending upwardly from the top surface of the bottom plate and having a transverse bottom edge coupled to the top surface, the transverse stiffening wall having a first edge couped to a first radial stiffening wall of the plurality of radial stiffening walls and a second edge opposite the first edge couped to a second radial stiffening wall of the plurality of radial stiffening walls.
3. The adjustable foundation support of embodiments 1 or 2 where the centermost edge of each of the plurality of radial stiffening walls is longer than the outermost edge of each of the plurality of radial stiffening walls.
4. The adjustable foundation support of any one of embodiments 1-3 where the base is molded as a single unit.
5. The adjustable foundation support of any one of embodiments 1-4 where the first buttress thread comprises a first root and the second buttress thread comprises a second root, the first root and the second root include a minimum root radius of at least 0.2 mm, or at least 0.3 mm, or at least 0.4 mm, or at least 0.5 mm, or at least 0.6 mm, or at least 0.7 mm, or at least 0.8 mm, or at least 0.9 mm, or at least 1.0 mm, or at least 1.1 mm, or at least 1.2 mm, or at least 1.3 mm, or at least 1.4 mm, or at least 1.5 mm, or at least 1.6 mm, or at least 1.7 mm, or at least 1.8 mm, or at least 1.9 mm, or at least 2.0 mm, or at least 2.1 mm, or at least 2.2 mm, or at least 2.3 mm, or at least 2.4 mm, or at least 2.5 mm.

6. An adjustable support for supporting a raised floor above a ground surface through a post, the adjustable support comprising a base having a bottom plate with a bottom surface and a first support structure extending upwardly from the bottom plate, the first support structure being fixed to the bottom plate at a proximal portion and having a first thread with a first thread axis arranged substantially perpendicular to the bottom surface of the bottom plate, the bottom surface of the bottom plate configured to rest upon the ground surface when installed; and a post engagement structure having a post support on a top portion and a second thread opposite the top portion of the post support, the post support configured to hold thereon a bottom end of the post, the second thread configured to selectively engage the first thread of the base to adjust a height of the post support relative to the base; wherein, during an installation procedure, a top end of the post is coupled with the raised floor, the bottom surface of the base is configured to be set on the ground surface beneath the post with the first thread threadably engaged with the second thread to adjustably couple the post engagement structure to the base, the post engagement structure is configured to be rotated to raise the height of the post engagement structure so that the post support contacts the bottom end of the post such that a load of the raised floor is transferred through the post, to the post engagement structure, into the base, and being distributed on the ground surface through the bottom plate.

7. The adjustable foundation support of embodiment 6 where the first thread is a first buttress thread and the second thread is a second buttress thread cooperatively configured to bear the load of the of the raised floor directed downwards.

8. The adjustable foundation support of embodiments 6 or 7 where the first buttress thread comprises a first root and the second buttress thread comprises a second root, the first root and the second root include a minimum root radius of at least 0.2 mm, or at least 0.3 mm, or at least 0.4 mm, or at least 0.5 mm, or at least 0.6 mm, or at least 0.7 mm, or at least 0.8 mm, or at least 0.9 mm, or at least 1.0 mm, or at least 1.1 mm, or at least 1.2 mm, or at least 1.3 mm, or at least 1.4 mm, or at least 1.5 mm, or at least 1.6 mm, or at least 1.7 mm, or at least 1.8 mm, or at least 1.9 mm, or at least 2.0 mm, or at least 2.1 mm, or at least 2.2 mm, or at least 2.3 mm, or at least 2.4 mm, or at least 2.5 mm.

9. The adjustable foundation support of any one of embodiments 6-8 where the first support structure comprises a columnar structure.

10. The adjustable foundation support of any one of embodiments 6-9 where the columnar structure comprises a bore with a bore axis of the bore arranged substantially perpendicular to the bottom surface of the bottom plate, and the first thread comprises an internal thread formed within the bore.

11. The adjustable foundation support of any one of embodiments 6-10 where the post engagement structure further comprises a boss protruding from a bottom portion of the post engagement structure opposite the top portion, and the second thread comprises an external thread formed about the boss, the external thread of the boss being configured to threadably engage the internal thread of the bore to adjust a height of the post support.

12. The adjustable foundation support of any one of embodiments 6-11 where the base further comprises a perimeter stiffening wall coupled to and extending upwardly from the from a top surface of the bottom plate; a plurality of radial stiffening walls each radially extending upwardly from the top surface of the bottom plate and having a bottom edge coupled to the top surface, each of the plurality of radial stiffening walls having a centermost edge coupled to the columnar structure and an outermost edge coupled to the perimeter stiffening wall; and a transverse stiffening wall extending upwardly from the top surface of the bottom plate and having a transverse bottom edge coupled to the top surface, the transverse stiffening wall having a first edge couped to a first radial stiffening wall of the plurality of radial stiffening walls and a second edge opposite the first edge couped to a second radial stiffening wall of the plurality of radial stiffening walls.

13. The adjustable foundation support of any one of embodiments 6-12 where the centermost edge of each of the plurality of radial stiffening walls is longer than the outermost edge of each of the plurality of radial stiffening walls.

14. The adjustable foundation support of any one of embodiments 6-13 where the base is molded as a single unit.

15. The adjustable foundation support of any one of embodiments 6-14 where the post engagement structure further comprises a post stiffening wall extending upwardly from the top portion to further delineate the post support, wherein the post stiffening wall is configured to prevent the bottom ed of the post from sliding off the post support.

16. A method of installing an adjustable support, comprising providing the adjustable support comprising a base having a bottom plate with a bottom surface and a first support structure extending upwardly from the bottom plate, the first support structure being fixed to the bottom plate at a proximal portion and having a first thread with a first thread axis arranged substantially perpendicular to the bottom surface of the bottom plate, the bottom surface of the bottom plate configured to rest upon the ground surface when installed; and a post engagement structure having a post support on a top portion and a second thread opposite the top portion of the post support, the post support configured to hold thereon a bottom end of the post, the second thread configured to selectively engage the first thread of the base to adjust a height of the post support relative to the base; coupling the post engagement structure to the base with the first thread threadably engaged with the second thread; positioning the adjustable support with the base positioned atop a support surface, such that the post support of the post engagement structure is positioned directly beneath a bottom end of a post extending downward from a raised floor structure; rotating the post engagement structure relative to the base to change a vertical position of the post engagement structure so that the post support is in close proximity or contacting the bottom end of the post; and supporting the raised floor with the bottom end of the post resting upon the post support, such that a load of the raised floor is transferred through the post, to the post engagement structure, into the base, and being distributed on the ground surface through the bottom plate.

17. The method of installing the foundation support of embodiment 16 where the first thread is a first buttress thread and the second thread is a second buttress thread cooperatively configured to bear the load of the of the raised floor directed downwards.

18. The method of installing the foundation support of embodiments 16 or 17 where the first buttress thread comprises a first root and the second buttress thread comprises a second root, the first root and the second root include a minimum root radius of at least 0.2 mm, or at least 0.3 mm, or at least 0.4 mm, or at least 0.5 mm, or at least 0.6 mm, or at least 0.7 mm, or at least 0.8 mm, or at least 0.9 mm, or at least 1.0 mm, or at least 1.1 mm, or at least 1.2 mm, or at least 1.3 mm, or at least 1.4 mm, or at least 1.5 mm, or at least 1.6 mm, or at least 1.7 mm, or at least 1.8 mm, or at least 1.9 mm, or at least 2.0 mm, or at least 2.1 mm, or at least 2.2 mm, or at least 2.3 mm, or at least 2.4 mm, or at least 2.5 mm.

19. The method of installing the foundation support of any one of embodiments 16-18 where the first support structure comprises a columnar structure with a bore with a bore axis of the bore arranged substantially perpendicular to the bottom surface of the bottom plate, and the first thread comprises an internal thread formed within the bore.

20. The method of installing the foundation support of any one of embodiments 16-19 where the post engagement structure further comprises a boss protruding from a bottom portion of the post engagement structure opposite the top portion, and the second thread comprises an external thread formed about the boss, the external thread of the boss being configured to threadably engage the internal thread of the bore to adjust a height of the post support.

In closing, it is to be understood that, although aspects of the present specification are highlighted by referring to specific embodiments, one skilled in the art will readily appreciate that these disclosed embodiments are only illustrative of the principles of the subject matter disclosed herein. The specific embodiments are not intended to be exhaustive or to limit the invention to the precise forms disclosed. Therefore, it should be understood that the disclosed subject matter is in no way limited to a particular compound, composition, article, apparatus, methodology, protocol, and/or reagent, etc., described herein, unless expressly stated as such. In addition, those of ordinary skill in the art will recognize that certain changes, modifications, permutations, alterations, additions, subtractions and sub-combinations thereof can be made in accordance with the teachings herein without departing from the spirit of the present specification. It is therefore intended that the scope of the invention is not to be limited by this detailed description. Furthermore, it is intended that the following appended claims and claims hereafter introduced are interpreted to include all such changes, modifications, permutations, alterations, additions, subtractions and sub-combinations as are within their true spirit and scope.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified, thus fulfilling the written description of all Markush groups used in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement and support for the phrases "consisting essentially of" and "consisting of."

Lastly, the terminology used herein is for the purpose of describing particular embodiments only and is not intended to limit the scope of the present invention, which is defined solely by the claims. Accordingly, the present invention is not limited to that precisely as shown and described.

What is claimed is:

1. An adjustable support for supporting a raised floor above a ground surface through a post, the adjustable support comprising:

a base having a bottom plate with a bottom surface and a columnar structure extending upwardly from the bottom plate, the columnar structure being fixed to the bottom plate at a proximal portion and having a bore formed into the columnar structure and having a first buttress thread, a first thread axis arranged substantially perpendicular to the bottom surface of the bottom plate, the bottom surface of the bottom plate configured to rest upon the ground surface when installed; and a post engagement structure having a post support on a top portion, a stiffening wall extending upwardly from the top portion to delineate a post bottom end region configured to receive thereon and continuously surround a bottom end of the post and configured to prevent the bottom end of the post from sliding off the post support, and a boss protruding from a bottom portion of the post support with a second buttress thread formed on the boss, the second buttress thread of the boss configured to threadably engage the first buttress thread of the bore to adjust a height of the post support;

wherein, during an installation procedure, a top end of the post is configured to be coupled with the raised floor, the bottom surface of the base is configured to be set on the ground surface beneath the post with the boss threadably inserted into the bore and the second buttress thread engaged with the first buttress thread to adjustably secure the post engagement structure to the base, the post engagement structure is configured to be rotated to raise a height of the post engagement structure so that the post support contacts the bottom end of the post so that a load of the raised floor is transferred through the post, to the post engagement structure, into the base, to be distributed on the ground surface through the bottom plate.

2. The adjustable support of claim 1 wherein the base further comprises:

a perimeter stiffening wall coupled to and extending upwardly from a top surface of the bottom plate;

a plurality of radial stiffening walls each radially extending upwardly from the top surface of the bottom plate and having a bottom edge coupled to the top surface, each of the plurality of radial stiffening walls having a centermost edge coupled to the columnar structure and an outermost edge coupled to the perimeter stiffening wall; and a transverse stiffening wall extending upwardly from the top surface of the bottom plate and having a transverse bottom edge coupled to the top surface, the transverse stiffening wall having a first edge couped to a first radial stiffening wall of the plurality of radial stiffening walls and a second edge opposite the first edge couped to a second radial stiffening wall of the plurality of radial stiffening walls.

3. The adjustable support of claim 2 wherein the centermost edge of each of the plurality of radial stiffening walls is longer than the outermost edge of each of the plurality of radial stiffening walls.

4. The adjustable support of claim 1 wherein the post engagement structure includes an integrally molded nut portion beneath the post support configured to provide a tool purchase to enable application of a torque sufficient to turn the post engagement structure under loading conditions.

5. The adjustable support of claim 1 wherein the first buttress thread comprises a first root and the second buttress thread comprises a second root, the first root and the second root include a minimum root radius of at least 0.2 mm, or at least 0.3 mm, or at least 0.4 mm, or at least 0.5 mm, or at least 0.6 mm, or at least 0.7 mm, or at least 0.8 mm, or at least 0.9 mm, or at least 1.0 mm, or at least 1.1 mm, or at least 1.2 mm, or at least 1.3 mm, or at least 1.4 mm, or at least 1.5 mm, or at least 1.6 mm, or at least 1.7 mm, or at least 1.8 mm, or at least 1.9 mm, or at least 2.0 mm, or at least 2.1 mm, or at least 2.2 mm, or at least 2.3 mm, or at least 2.4 mm, or at least 2.5 mm.

6. An adjustable support for supporting a raised floor above a ground surface through a post, the adjustable support comprising:

a base having a bottom plate with a bottom surface and a first support structure extending upwardly from the bottom plate, the first support structure being fixed to the bottom plate at a proximal portion and having a first thread with a first thread axis arranged substantially perpendicular to the bottom surface of the bottom plate, the bottom surface of the bottom plate configured to rest upon the ground surface when installed; and a post engagement structure having a post support on a top portion and a second thread opposite the top portion of the post support, the post support configured to hold thereon a bottom end of the post, the second thread configured to selectively engage the first thread of the base to adjust a height of the post support relative to the base the post engagement structure further including an integrally molded nut portion beneath the post support configured to provide a tool purchase to enable application of a torque sufficient to turn the post engagement structure under loading conditions;

wherein, during an installation procedure, a top end of the post is configured to be coupled with the raised floor, the bottom surface of the base is configured to be set on the ground surface beneath the post with the first thread threadably engaged with the second thread to adjustably couple the post engagement structure to the base, the post engagement structure is configured to be rotated to raise the height of the post engagement structure so that the post support contacts the bottom end of the post such that a load of the raised floor is transferred through the post, to the post engagement structure, into the base, and being distributed on the ground surface through the bottom plate.

7. The adjustable support of claim 6 wherein the first thread is a first buttress thread and the second thread is a second buttress thread cooperatively configured to bear the load of the of the raised floor directed downwards.

8. The adjustable support of claim 7 wherein the first buttress thread comprises a first root and the second buttress thread comprises a second root, the first root and the second root include a minimum root radius of at least 0.2 mm, or at least 0.3 mm, or at least 0.4 mm, or at least 0.5 mm, or at least 0.6 mm, or at least 0.7 mm, or at least 0.8 mm, or at least 0.9 mm, or at least 1.0 mm, or at least 1.1 mm, or at least 1.2 mm, or at least 1.3 mm, or at least 1.4 mm, or at least 1.5 mm, or at least 1.6 mm, or at least 1.7 mm, or at least 1.8 mm, or at least 1.9 mm, or at least 2.0 mm, or at least 2.1 mm, or at least 2.2 mm, or at least 2.3 mm, or at least 2.4 mm, or at least 2.5 mm.

9. The adjustable support of claim 6 wherein the first support structure comprises a columnar structure.

10. The adjustable support of claim 9 wherein the columnar structure comprises a bore with a bore axis of the bore arranged substantially perpendicular to the bottom surface of the bottom plate, and the first thread comprises an internal thread formed within the bore.

11. The adjustable support of claim 9 wherein the post engagement structure further comprises a boss protruding from a bottom portion of the post engagement structure opposite the top portion, and the second thread comprises an external thread formed about the boss, the external thread of the boss being configured to threadably engage the internal thread of the bore to adjust a height of the post support.

12. The adjustable support of claim 9 wherein the base further comprises:

a perimeter stiffening wall coupled to and extending upwardly from a top surface of the bottom plate;

a plurality of radial stiffening walls each radially extending upwardly from the top surface of the bottom plate and having a bottom edge coupled to the top surface, each of the plurality of radial stiffening walls having a centermost edge coupled to the columnar structure and an outermost edge coupled to the perimeter stiffening wall; and a transverse stiffening wall extending upwardly from the top surface of the bottom plate and having a transverse bottom edge coupled to the top surface, the transverse stiffening wall having a first edge couped to a first radial stiffening wall of the plurality of radial stiffening walls and a second edge opposite the first edge couped to a second radial stiffening wall of the plurality of radial stiffening walls.

13. The adjustable support of claim 6 wherein the centermost edge of each of the plurality of radial stiffening walls is longer than the outermost edge of each of the plurality of radial stiffening walls.

14. The adjustable support of claim 6 wherein the base is molded as a single unit.

15. The adjustable support of claim 6 wherein the post engagement structure further comprises a post stiffening wall extending upwardly from the top portion to further delineate the post support, wherein the post stiffening wall is configured to prevent the bottom end of the post from sliding off the post support.

16. A method of installing an adjustable support, comprising:

providing the adjustable support comprising:

a base having a bottom plate with a bottom surface and a first support structure extending upwardly from the bottom plate, the first support structure being fixed to the bottom plate at a proximal portion and having a first thread with a first thread axis arranged substantially perpendicular to the bottom surface of the bottom plate, the bottom surface of the bottom plate configured to rest upon the ground surface when installed; and a post engagement structure having a post support on a top portion, a stiffening wall extending upwardly from the top portion to delineate a post bottom end region and a second thread opposite the top portion of the post support, the second thread configured to selectively engage the first thread of the base to adjust a height of the post support relative to the base;

coupling the post engagement structure to the base with the first thread threadably engaged with the second thread;

positioning the adjustable support with the base positioned atop a support surface, such that the post support of the post engagement structure is positioned directly beneath a bottom end of a post extending downward from a raised floor structure;

fastening a top end of the post to a beam of the floor structure;

rotating the post engagement structure relative to the base to change a vertical position of the post engagement structure so that the post support is in close proximity or contacting the bottom end of the post and positioning the bottom end of the post within the post bottom end region such that the bottom end of the post is prevented from moving off the post engagement structure; and supporting the raised floor with the bottom end of the post resting upon the post support, such that a load of the raised floor is transferred through the post, to the post engagement structure, into the base, and being distributed on the ground surface through the bottom plate.

17. The method of claim 16 wherein the first thread is a first buttress thread and the second thread is a second buttress thread cooperatively configured to bear the load of the of the raised floor directed downwards.

18. The method of claim 17 wherein the post engagement structure further includes an integrally molded nut portion beneath the post support, the method further comprising:

adjusting the height of the raised floor by rotating the post engagement structure relative to the base while supporting the load of the raised floor by application of a torque from a tool sufficient to turn the post engagement structure under load.

19. The method of claim 16 wherein the first support structure comprises a columnar structure with a bore with a bore axis of the bore arranged substantially perpendicular to the bottom surface of the bottom plate, and the first thread comprises an internal thread formed within the bore.

20. The method of claim 19 wherein the post engagement structure further comprises a stiffening wall extending upwardly from the top portion to delineate a post bottom end region configured to receive thereon a bottom end of the post and configured to prevent the bottom end of the post from moving off the post support.

* * * * *